United States Patent [19]

Moen et al.

[11] 4,114,012

[45] Sep. 12, 1978

[54] MICROWAVE FURNACE

[76] Inventors: George E. Moen, 1876 Miramonte Ave., Mountain View, Calif. 94040; Vincent P. De Vito, 3716 Atwater, Sacramento, Calif. 95825

[21] Appl. No.: 818,384

[22] Filed: Jul. 25, 1977

[51] Int. Cl.[2] ..... H05B 9/06

[52] U.S. Cl. ..... 219/10.55 R; 126/110 AA; 219/10.55 A

[58] Field of Search ..... 219/10.55 R, 10.55 A, 219/10.55 M; 126/99 A, 110 R, 110 AA, 110 D

[56] References Cited

U.S. PATENT DOCUMENTS

| | | | |
|---|---|---|---|
| 3,816,689 | 6/1974 | Long | 219/10.55 R |
| 3,854,219 | 12/1974 | Staats | 219/10.55 R |

*Primary Examiner*—Arthur T. Grimley
*Attorney, Agent, or Firm*—Thomas H. Olson

[57] ABSTRACT

A microwave furnace having an impervious housing with an inlet and an outlet and a fan or blower for inducing within the housing a moving air stream. Supported within the housing within the air stream is a body of microwave lossy material. Also within the housing upstream of the body of microwave lossy material is a microwave source and a transmission line for transmitting the microwave energy from the source to the body. The body is configured with respect to the cross sectional shape of the air flow path such that the moving air passes through a relatively small gap between the body and the inner surface of the housing, thereby affording sufficient residence time for the air to be heated by radiation from the body.

4 Claims, 4 Drawing Figures

MICROWAVE FURNACE

BACKGROUND OF THE INVENTION

1. Field of the Invention

This invention relates to furnaces for space heating and more particularly to a furnace in which the heat is produced from microwave energy.

2. Description of the Prior Art

U.S. class 126, subclasses 110 and 116, contain numerous references disclosing furnaces that are powered by natural gas, oil and like materials from which heat energy is extracted by combustion. All such furnaces require extensive venting so that the products of combustion do not adversely affect the occupants of the buildings in which such furnaces are installed. This fact makes installation of such furnaces expensive, particularly when such furnaces are installed in a pre-existing building.

There are presently available on the market microwave ovens which include containers or sheets of microwave lossy material so that a preparer of food can achieve a degree of browning of the food while cooking the same.

SUMMARY OF THE INVENTION

According to the present invention there is a more or less conventional housing constructed of sheet metal or the like, the housing having a cold air inlet opening and a warm air outlet opening. Within the housing is a fan or blower for inducing air flow along a path within the housing from the inlet opening to the outlet opening. Disposed within the air flow path is a body of microwave lossy material, a microwave source such as a magnetron oscillator, and a transmission line for transmitting microwave energy from the source to the body of lossy material. Air passing over the lossy material is heated so that the air exiting the outlet opening can be employed for space heating and the like.

An object of the invention is to provide a furnace that requires no venting as do furnaces which rely on combustion to produce heat. This object is achieved because the sole source of power input to the furnace is electric power which can be converted to heat according to the invention without producing gases that adversely affect the occupants of a building in which the furnace is installed.

Another object of the invention is to optimize heat transfer from the microwave lossy material to the passing air. This object is achieved by forming the microwave lossy material such that it occupies the air path with the exception of a substantially uniformly dimensioned gap circumscribing the body of lossy material. The gap is dimensioned to pass sufficient heated air therethrough and to assure that the air upstream thereof has sufficient residence time with the microwave lossy material to effect efficient heat transfer to the air. Heat transfer is also optimized by providing a microwave lossy body that has a partially spherical surface.

A further object is to provide a microwave powered furnace that optimizes conversion of electric power to heat energy. This object is achieved in part by installing the microwave power source upstream of the microwave lossy material so that the heat produced by the power source is transferred to relatively cool air flowing therepast. Additionally, the air is preheated by so positioning the microwave power source.

A feature and advantage of the present invention is that furnaces of virtually any size and configuration can be provided and a given furnace can be operated in any orientation since it does not rely on gravity for operation.

Another feature and advantage of a furnace embodying the present invention is that it can produce warm air almost immediately upon being activated and the amount of heated air can be closely controlled because known microwave sources can be precisely controlled.

The foregoing together with other objects, features and advantages will be more apparent after referring to the following specification and the accompanying drawings.

DESCRIPTION OF THE PREFERRED EMBODIMENT

Figure 1:
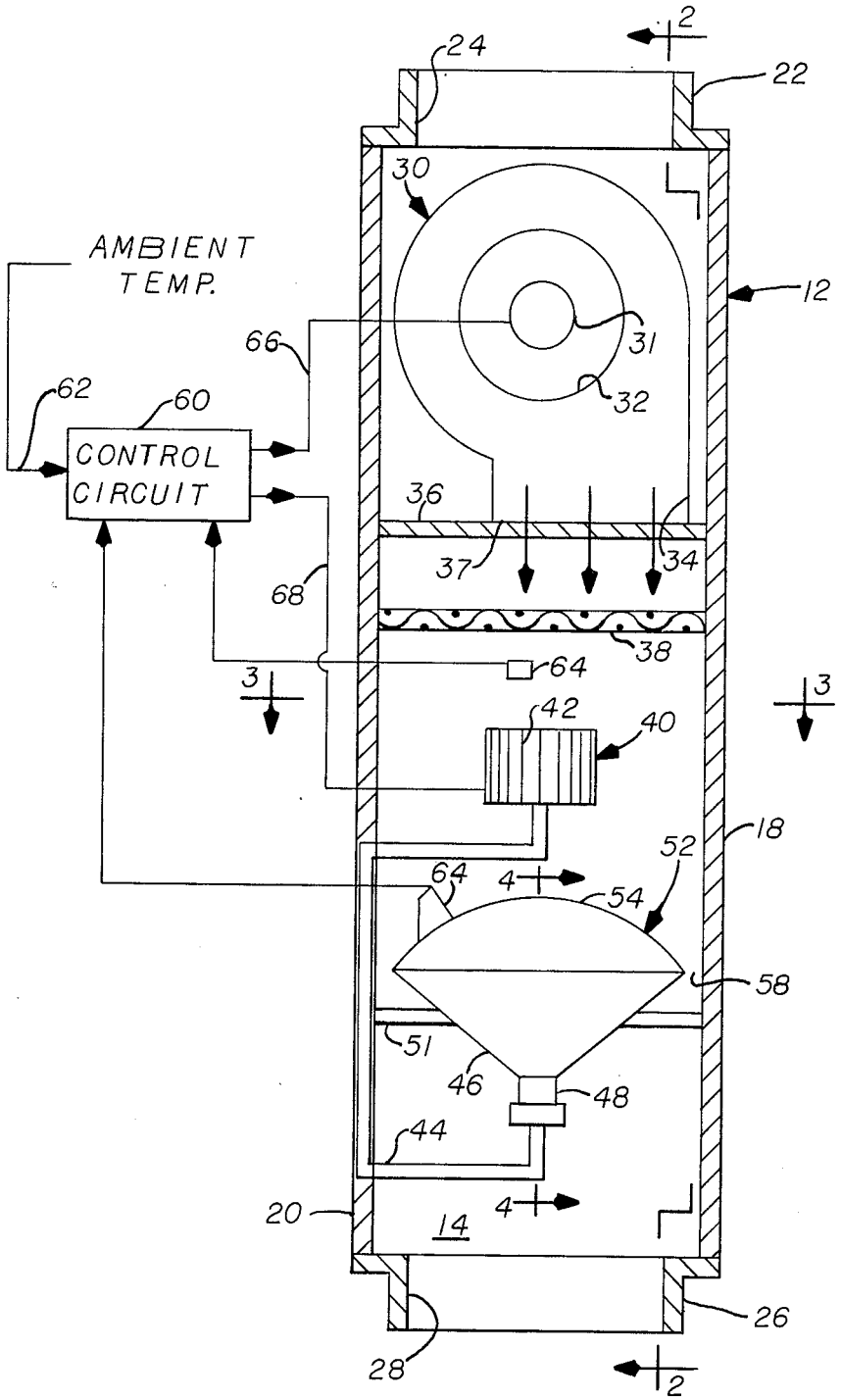
FIG. 1 is a side elevation view in cross section of a furnace embodying the invention.

Referring more particularly to the drawings, reference numeral 12 indicates a housing defined by side walls 14 and 16, a front wall 18 and a rear wall 20.

Figure 2:
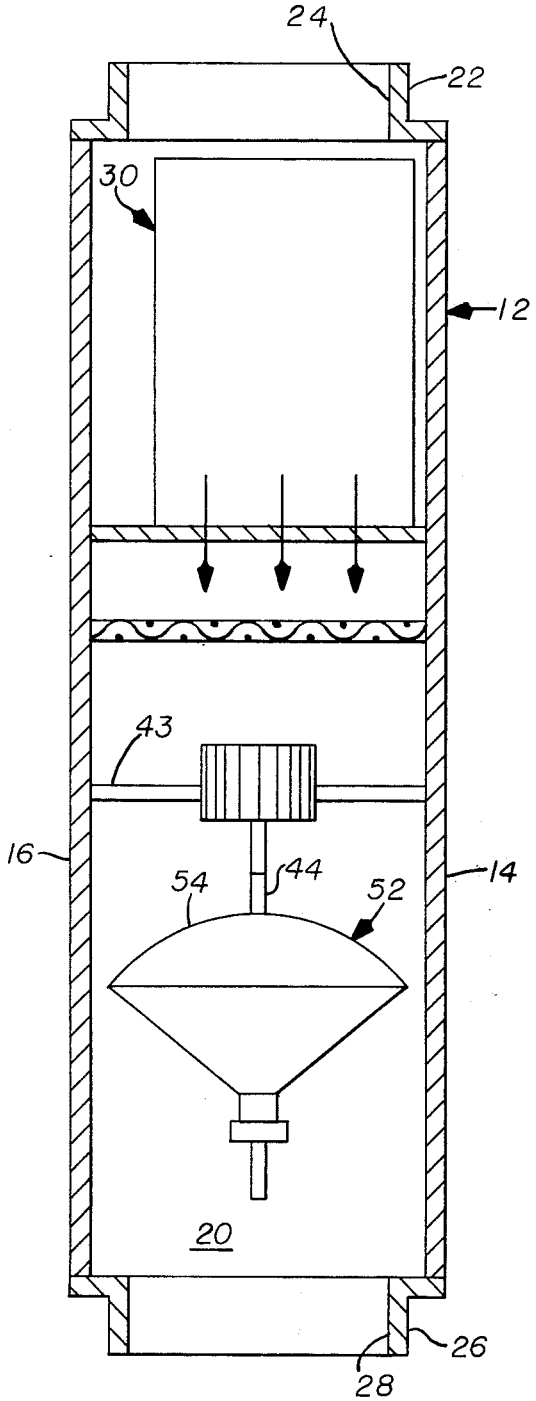
FIG. 2 is a front elevation view in cross section taken on line 2—2 of FIG. 1.
Figure 3:
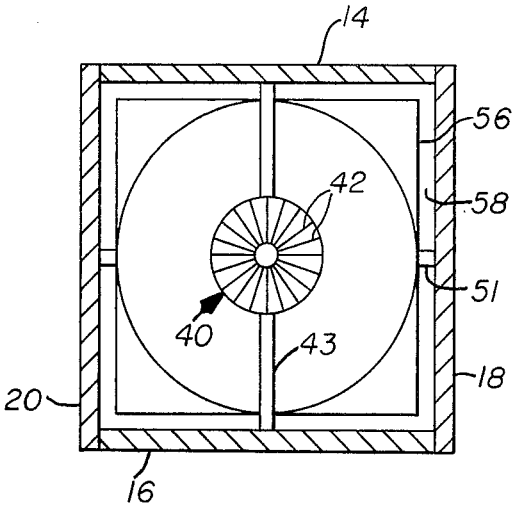
FIG. 3 is a cross sectional view taken along line 3—3 of FIG. 1.
Figure 4:
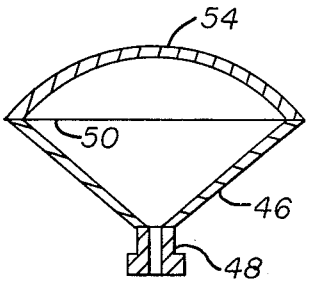
FIG. 4 is a cross sectional view of the heat exchanger taken along line 4—4 of FIG. 1.

As can be seen most clearly in FIG. 3, the side walls, front wall and rear wall cooperate to form an air flow path that, in the embodiment shown in the drawings, has a generally square cross sectional shape. At one end of housing 12 (the upper end as viewed in FIGS. 1 and 2) is secured an end fitting 22 which in addition to affording structural rigidity to the housing defines an inlet opening 24. A similar end fitting 26 is provided at the opposite end of the housing and defines an outlet opening 28.

For inducing air flow from inlet 24 to outlet 28 through the housing a fan or blower 30 of conventional form is disposed within housing 12. The fan has a motor 31, an inlet 32 and an outlet 34 so that when the motor is energized, air is drawn into the housing through inlet 24 and discharged through outlet 28. A plate 36 is secured rigidly to the walls that define housing 12 and supports fan 30 the plate having an aperture 37 in registry with blower outlet 34. Downstream of fan 30 is a filter 38 which excludes particulates from the part of the housing below the filter and acts as a shield to prevent leakage of microwave energy back through the inlet 24. The showing in the drawings of filter 38 as a fixed member is for the purpose of simplifying the drawings; filter 38 typically is supported so that it can be removed for maintenance and/or replacement at appropriate intervals.

Downstream of the filter 38 is the heat producing section of the furnace, such heat producing section being powered by a microwave energy source 40. In one furnace designed according to the present invention microwave power source 40 is constituted by a continuous wave magnetron operating in the 2450 MHz range. The power output of the magnetron is in the 600–700 watts range, such unit being satisfactory for a relatively small building, such as a house trailer or the like.

As shown in the drawings, microwave energy source 40 typically has a plurality of radially extending cooling fins 42 which assist in maintaining the temperature of the magnetron in the source within specified limits. As can be seen most clearly in FIG. 2, energy source 40 is supported by a crossbar 43 so that the relatively cool air emanating from outlet 34 of blower 30 passes over cooling fins 42. This not only maintains the temperature of the microwave source within a proper range but preheats the air to a minor degree.

The RF output of source 40 is conducted through a transmission line, such as a waveguide 44 or the like, to a transition 46, which in the embodiment shown is a conical shaped member which diverges from a lower inlet end 48 to which waveguide 44 is connected to a relatively large upper extremity or mouth 50 which has a diameter slightly less than the cross sectional dimensions of the interior of housing 12. A crossbar 51 supports transition 46 centrally within the interior of housing 12. Transition 46 is constructed of conductive material so that the microwave energy supplied through waveguide 44 is confined therein without leakage. Sealed to the upper end 50 of the transition is a heat exchanger 52. The heat exchanger is formed of material that is lossy with respect to microwave energy, i.e., material that converts the microwave energy to heat. One material having the required characteristics is glass in which tin oxide is impregnated. This is a well known material that heats upon being bombarded by microwave energy. The heat exchanger includes a body having a central partially spherical wall portion 54 which has a diameter at the lower portion thereof corresponding to the diameter of mouth 50 of the transition. The spherical portion has an upward convex surface that is exposed to the air flow path induced by blower 30 and a downward concave surface exposed to microwave energy transmitted through transmission line 44. The heat exchanger is sealed to the transition by a suitable material such as "Metex" gasket. Such material prevents leakage of microwave energy. Surrounding spherical portion 54 is a flange 56 which has a peripheral shape geometrically similar to the shape of the interior of housing 12 but somewhat less than some interior dimension so as to form a gap 58 between the flange and the walls that define housing 12. Flange 56 can be integral with spherical portion 54 or can be joined thereto by any suitable expedient.

Although the specific elements of the control system of the present invention do not constitute a part of the novel subject matter, a description of the control system will be of use in understanding the operation of the device. There is a control circuit 60 which receives an input at 62 from a thermostat or like device that senses the temperature in the space to be heated, i.e., the space in communication with outlet 28. There is also a temperature sensor 64 which senses the temperature of heat exchanger 52 and supplies a signal corresponding to that temperature to the control circuit. Additionally, an air flow sensor 64 senses the air flowing over microwave power source 40 and produces a signal to the control system indicating the presence of such flow. Finally, the control circuit has an output 66 which activates the motor 31 of blower 30 and an output 68 which activates microwave power source 40.

In operation a furnace embodying the invention is installed such that inlet 24 communicates with a cold air return from the space to be heated and outlet 28 communicates with the space either directly or through a suitable system of ducts. After electrical connections are made, the furnace is ready for operation. When a low ambient temperature is sensed and supplied to control circuit 60 at input 62, the circuit energizes fan motor 31 so that air moves through the interior of housing 12. When the air is moving, sensor 64 detects the same and activates microwave energy source 40. The energy produced by the microwave energy source is transmitted through transmission line 44 and transition 46 into impingement with the concave surface of spherical portion 54 of heat exchanger 52. Because the spherical portion is constructed of microwave lossy material, the material is heated by impingement of microwave energy and the convex surface thereof is correspondingly heated. Air moving toward the convex surface from blower outlet 34 impinges on the heated convex surface and is heated thereby. Sufficient residence time for the air in contact with the heat exchanger is assured by the provision of gap 58 between the interior of the walls that form housing 12 and the periphery of heat exchanger 52. In one furnace designed according to the present invention a gap having a width of about one inch provided sufficient residence time for the air to be heated and in addition provided an adequate rate of outflow of heated air through outlet 28. Should the temperature of heat exchanger 52 exceed some preselected point, sensor 64 causes control circuit 60 to deenergize microwave source 40 until the temperature drops below the point.

Because microwave source 40 requires little, if any, warm-up time, a furnace embodying the present invention can produce hot air through outlet 28 in a very short time after being turned on. Moreover, because none of the elements of the furnace rely on gravity, a furnace of a given configuration can be installed in virtually any orientation as may be dictated by the space available for its installation.

Thus it will be seen that the present invention provides a furnace which is economical to construct, install and operate and which can produce heat at a temperature which can be closely and continuously controlled. The embodiment specifically disclosed hereinabove and in the accompanying drawing is merely exemplary, because it will be obvious to those skilled in the art that many adaptations and modifications can be made without departing from the true spirit and scope of the invention.

What is claimed is:

1. A furnace comprising an impervious housing having an inlet opening and an outlet opening spaced from the inlet opening, means for inducing air flow along a path through said housing from said inlet opening to said outlet opening, heat exchanger means disposed within said housing for heating the air flowing therethrough from said inlet opening to said outlet opening, said heat exchanger means including a body having a wall that is microwave lossy, a microwave source and a transmission line between said microwave source and said body for transmitting microwave energy from said source to said body to heat the body.

2. A furnace according to claim 1 wherein said body includes a partially spherical wall that has convex surface toward said inlet opening, said body having a concave surface opposite said convex surface, means downstream of said body for directing microwave energy from said transmission line substantially uniformly throughout said concave surface, said body having a flange circumscribing the same that has a profile geometrically similar to the shape of said housing and spaced from said housing to define a gap surrounding said body, said gap being sufficient to afford warm air flow therethrough and to enhance the residence time of air adjacent said convex surface.

3. A furnace according to claim 2 wherein said microwave energy directing means comprises a transition member having a conductive wall defining an inlet connected to said transmission line and diverging from said inlet to a mouth having a shape corresponding to the periphery of said spherical wall and means for attaching said spherical wall to said mouth to form a substantially microwave energy impervious joint therebetween.

4. A furnace according to claim 1 including means for mounting said microwave source upstream of said body so that said microwave source is cooled by air flowing from said inlet opening to said outlet opening.

* * * * *